United States Patent [19]

Playter, Jr.

[11] 4,254,952

[45] Mar. 10, 1981

[54] PITCHING PRACTICE DEVICE

[76] Inventor: George H. Playter, Jr., 125 N. Oakley St., Kansas City, Mo. 64123

[21] Appl. No.: 968,189

[22] Filed: Dec. 11, 1978

[51] Int. Cl.[3] ..... A63B 69/00

[52] U.S. Cl. ..... 273/26 A; 273/401

[58] Field of Search ..... 273/26 A, 29 A, 181 R, 273/181 A, 181 B, 181 C, 181 D, 181 J, 181 K, 181 F, 182 R, 182 A, 35 R, 102 R, 102 S, 127 R, 127 B, 102 S, , 102.4, 103, 105 R, 105.5, 101, 102.1 R, 102.1 B, 102.1 G, 102.2 A, 102.2 B, 102.2 R, 102.2 S, 102.3, 176 B, 176 D, 177 B, 183 R, 401, 400

[56] References Cited

U.S. PATENT DOCUMENTS

| | | | |
|---|---|---|---|
| 1,142,184 | 6/1915 | Lawrence | 273/26 A |
| 1,469,130 | 9/1923 | Whitehair | 273/176 B |
| 2,657,058 | 10/1953 | Mulcahy | 273/26 A |
| 2,873,969 | 2/1959 | Ziel | 273/26 A |
| 2,986,398 | 5/1961 | Oliver | 273/103 |
| 3,227,026 | 2/1969 | Mahoney | 273/26 A |
| 3,312,467 | 4/1967 | Dawson | 273/102 R |
| 3,810,616 | 5/1974 | Murphy | 273/26 A |
| 4,082,271 | 4/1978 | Martin | 273/26 A |
| 4,083,559 | 4/1978 | Owen, Jr. | 273/26 A |
| 4,127,267 | 11/1978 | Bay et al. | 273/26 A |

FOREIGN PATENT DOCUMENTS

| | | | |
|---|---|---|---|
| 416408 | 1/1977 | France | 273/102 S |

*Primary Examiner*—Richard C. Pinkham
*Assistant Examiner*—T. Brown
*Attorney, Agent, or Firm*—John A. Hamilton

[57] ABSTRACT

A pitching practice device consisting of a sheet of canvas or the like supported in a vertical plane, and having an aperture formed therein defining a strike zone, at which a baseball pitcher may pitch baseballs to develop his accuracy and control. For still greater accuracy of control, and to "catch" the balls, a canvas chute is attached to the rearward surface of the sheet, and divided into a plurality of sections each opening through the sheet aperture, for receiving and trapping any ball entering its opening. The sheet aperture is thus divided into zones for indicating, and recording, whether a pitched ball is "high", "low", "inside", "outside", or "down the middle". The sheet is resiliently supported to prevent damage either to the device or to the ball. The device may also be adapted for use, with a set of playing rules, as a competitive game, particularly for children.

5 Claims, 6 Drawing Figures

PITCHING PRACTICE DEVICE

Figure 1:
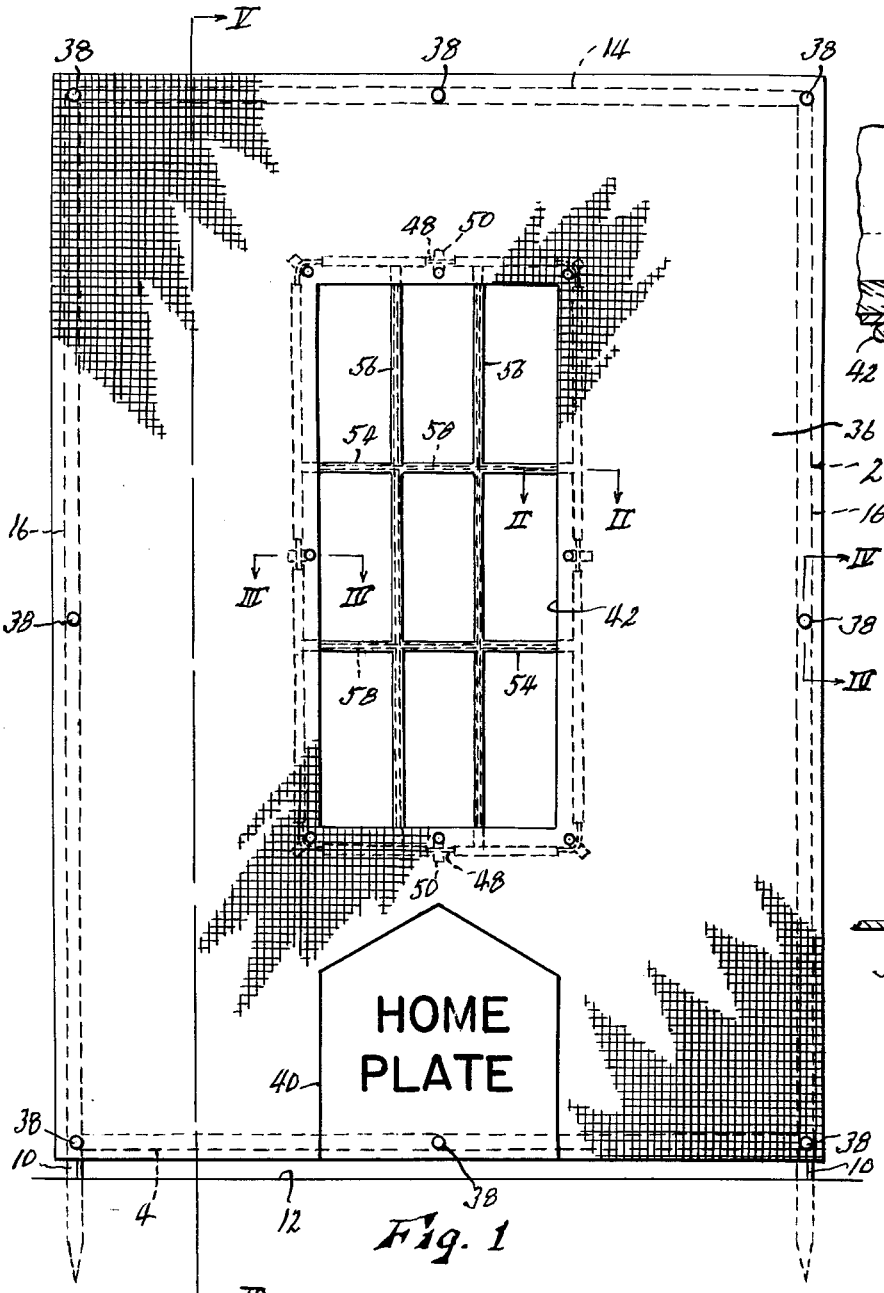

This invention relates to new and useful improvements in sports equipment, and has particular reference to a practice device for assisting baseball pitchers to improve their accuracy and control.

In baseball, automatic ball throwing machines for "pitching" balls to hitters have long been known, as an aid in batting practice, but so far as in within my knowledge, no mechanical aids for assisting pitchers in practice have been developed, pitching practice usually requiring the services of a human catcher. Not only is a human catcher not always readily available when a pitcher desires to practice, but even if available is not always able or accurate in indicating and recording whether a pitched ball is delivered accurately in any particular zone called for in a particular case. The provision of a practice device capable of performing these functions accurately and automatically is the primary object of the present invention. Generally, this object is accomplished by the provision of a device including a sheet of canvas or the like adapted to be supported vertically, and having an aperture formed therein, said aperture having a width equal to that of the home plate, and a height equal to the height of the strike zone for a batter of average height, that is, the vertical distance between the batter's knees and shoulders. The pitcher then pitches balls at said sheet, attempting to throw it through the aperture, passage of the ball through the aperture indicating he has thrown a strike, while if the ball hits or completely misses the sheet, he has thrown a "ball" or a "wild pitch".

Another object is the provision of a device of the character described with the addition of a flexible chute attached to the back side of the sheet with its open mouth covering the sheet aperture. The chute is closed at its rearward end, so as to trap and retain any ball entering it, so to act as a "catcher".

A further object is the provision of a device of the character described in which the chute is internally divided into a series of sections each having its open mouth registering with a specific zone of the sheet aperture, whereby the particular chute section in which the ball comes to rest will furnish positive proof, not only that the pitch was a "strike", but also whether it was "high", "low", "inside", "outside" or "down the middle". This is of course a refinement of the device providing for still greater development of control and accuracy by the pitcher.

A still further object is the provision of a device of the character described wherein the sheet aperture boundaries, the forward edges of the chute partitions, and the sheet itself, are all resiliently and yieldably supported, whereby to avoid damage thereto by hard-thrown balls, or damage to the balls themselves.

Still another object is the provision of a device of the character described which, by the adoption of simple sets of rules, may be adapted as a competitive game for children. The game may simulate an actual baseball game, and the rules may coincide as closely as possible with actual game conditions, such for example that a "strike" ball is more likely to produce a "hit" than a "ball", that "strikes" in the fringe sections of the chute are less likely to produce a "hit" than a pitch "down the middle", that sequential pitches in the same area of the strike zone are more likely to produce a "hit" than pitches scattered about the strike zone, the "down the middle" pitches, particularly if thrown in sequence, are likely to produce extra base hits or home runs, etc.

Other objects are extreme simplicity and economy of constructions, and convenience, efficiency and dependability of operation.

Figure 2:
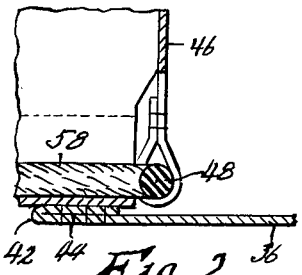
Figure 3:
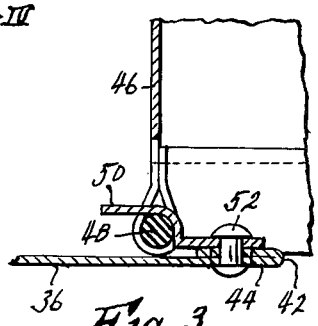
Figure 4:
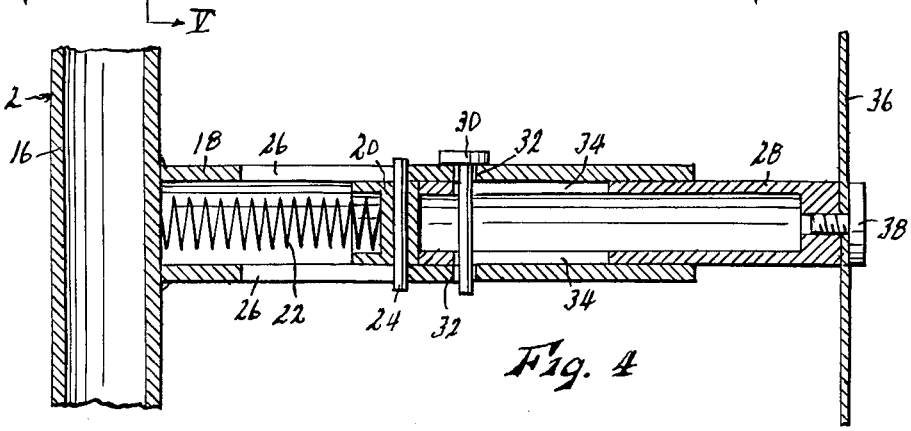
Figure 5:
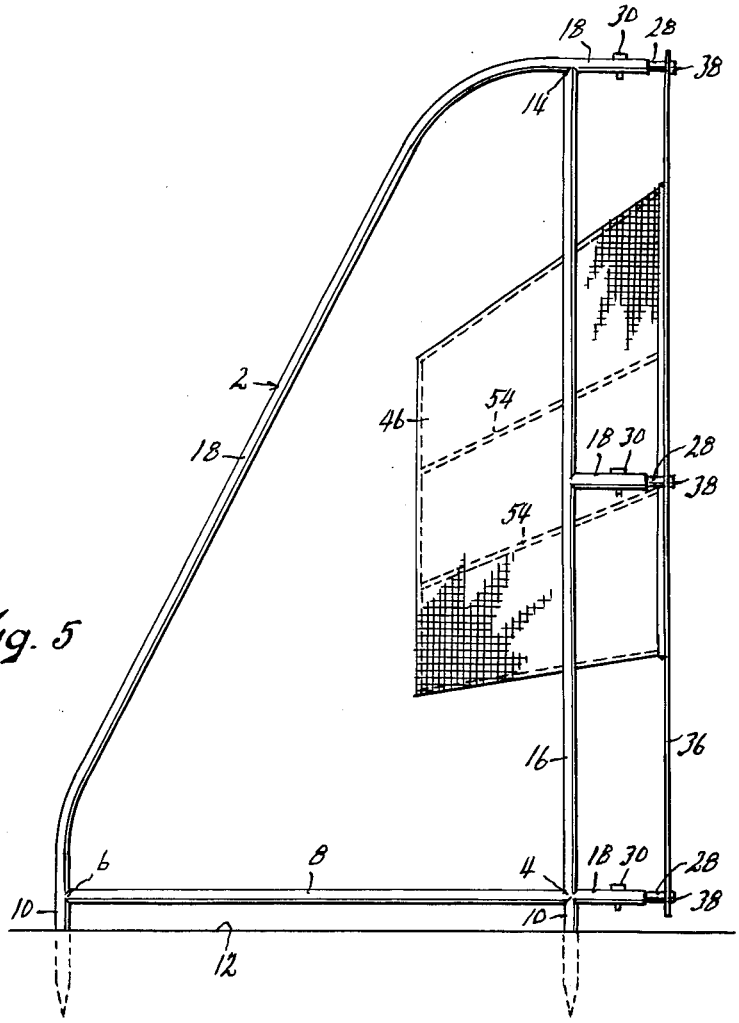
Figure 6:
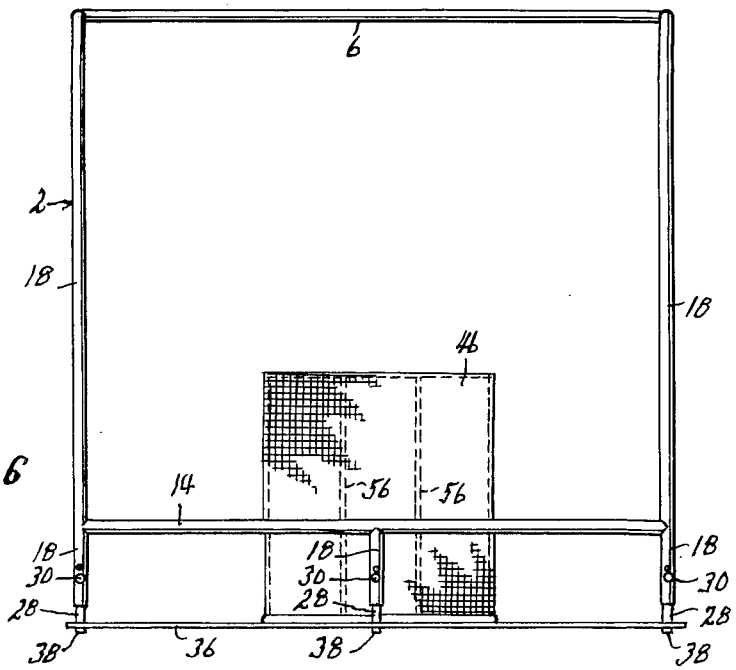

With these objects in view, as well as other objects which will appear in the course of the specification, reference will be had to the accompanying drawing, wherein:

FIG. 1 is a front elevational view of a pitching practice device embodying the present invention, shown operatively anchored in the ground, FIG. 2 is an enlarged, fragmentary sectional view taken on line II—II of FIG. 1, FIG. 3 is an enlarged, fragmentary sectional view taken on line III—III of FIG. 1, FIG. 4 is an enlarged, fragmentary sectional view taken on line IV—IV of FIG. 1, FIG. 5 is a side elevational view of the device, with parts omitted, and with the flexible ball chute extended, and FIG. 6 is a top plan view of the device as shown in FIG. 5.

Like reference numerals apply to similar parts throughout the several views, and the numeral 2 applies generally to a mounting stand including a horizontal, rectangular lower frame formed of pipe stock, and having a front bar 4, rear bar 6 and side bars 8. At each corner, said lower frame has a pointed leg 10 fixed thereto which may be driven into the ground 12 to anchor the stand. Rising from the forward edge of the lower frame is an open, rectangular front frame of which bar 4 serves as the lower bar, and having a horizontal top cross bar 14 and vertical side bars 16. The top edge of the front frame is affixed to the rearward edge of the lower frame by angled braces 18, in order to render the stand substantially rigid. Fixed to and extending forwardly from each corner of the front frame, and from the midpoint of each of its top, bottom and side bars, is a tubular socket member 18 open at its forward end.

Mounted slidably within the rearward portion of each of socket members 18 is a plunger 20 (see FIG. 4) urged forwardly by a spring 22, its forward movement being limited by a pin 24 fixed transversely therein and extending laterally outwardly therefrom to engage slidably in longitudinal slots 26 formed in the socket. FIG. 4 shows the plunger at the forward limit of its travel. Engaged for longitudinal sliding movement in the forward portion of the socket, and extending forwardly therefrom, is a tubular stud 28, the rearward end of which engages plunger 20, and the sliding movement of which is limited by the insertion of a headed pin 30 through transversely aligned holes 32 of socket member 18, and through longitudinally elongated slots 34 of stud 28. Each stud may be assembled with the frame by inserting it into its associated socket 18 until it contacts plunger 20, and dropping pin 30 into place, whereupon the parts are locked in assembly, and the studs are then mounted for yieldable rearward movement against plungers 20 and springs 22.

A rectangular target sheet 36, formed of a tough, flexible material such as canvas, and of slightly greater dimensions than the front frame of the stand, is disposed in a vertical plane and is secured to the forward ends of each of studs 28, for example by a large-headed screw 38 inserted rearwardly through the sheet adjacent its edge and threaded into the forward end of the stud.

Applied to the forward face of sheet 36, centrally of its lower edge, is suitable indicia 40, indicating the standard 16 inch width of home plate of a baseball diamond. Above said indicia, a rectangular aperture 42 is formed in the sheet, the edges of which may be hemmed as indicated at 44 in FIGS. 2 and 3. Said aperture is of the same width as the home plate indicia 40, and the upper and lower edges of said aperture, when the stand 2 is affixed in the ground as shown, are disposed respectively at the elevations of the average batter's shoulders and knees above ground level.

A flexible chute 46 (see FIGS. 5 and 6), also preferably formed of canvas, is attached to the rear surface of sheet 36, said chute being closed at its rearward end, but open at its forward end, or mouth, and of such dimensions as to encircle completely the aperture 42 of said sheet, and being secured around its forward edge to an endless loop of rubber or rubberized elastic cord 48 encircling said aperture in slightly outwardly spaced relation from the margin thereof, as by hemming the canvas of which said chute is formed around said cord. The chute is detachably connected to the sheet by engaging cord 48 around hooks 50 each fixed to the sheet by a rivet 52 (see FIG. 3), and disposed at the corners and midway along each edge of the aperture. This connection is not detailed in FIGS. 5 and 6, but may be understood by reference to FIGS. 1 and 3. The chute is of course formed of canvas and would normally hang downwardly behind sheet 36 by gravity, but is shown extended in FIGS. 5 and 6 better illustrate its configuration and component parts. The cord 48 serves not only as a mounting for chute 46, but also as a resilient tensile means tending to maintain sheet aperture 42 in its proper rectangular configuration.

In the particular embodiment of the device selected for illustration, chute 46 is divided longitudinally by a pair of horizontal partitions 54 (see FIG. 5) and a pair of vertical partitions 56 (see FIG. 6), all of said partitions also being formed of canvas, into nine sections each opening at the mouth of the chute. Each of said partitions is connected at its forward edge, as by hemming, to the corresponding elastic cord 58 of a grid of said cords consisting of a pair of horizontal cords and a pair of vertical cords extending across and connected at their ends to elastic cord loop 48. As best shown in FIG. 1, partitions 54 and 56 divide sheet aperture 42 into equal thirds, both horizontally and vertically, and a pitched baseball passing through any given zone of said aperture will enter the corresponding section of chute 46 and be trapped therein.

In operation, the pitcher stands at a prescribed distance in front of sheet 36 of the device, with the device set up as shown and described, and pitches baseballs at said sheet in the usual manner, of course attempting primarily to pitch it through aperture 42. Passage of the ball through said aperture registers a "strike", while any ball which hits sheet 36 registers a "ball". The sheet may be of such dimensions that any ball which misses it entirely may register as a "wild pitch". Any ball passing through aperture 42 is of course trapped in some pocket of chute 46, and furnishes positive proof of the "strike" thrown, and the particular "pocket" of the chute in which the ball comes to rest indicates the particular portion of the strike zone in which the ball was pitched, as an aid to the pitcher in developing his control and accuracy to a still greater degree.

As a pitched ball enters the chute, which normally hangs downwardly by gravity, it tends to lift and extend the chute to the rear, as shown in FIGS. 5 and 6. This action absorbs the momentum energy of the ball, so that generally by the time the ball reaches the back wall of the chute, its momentum will have been completely absorbed, and the chute, with the ball trapped therein, will again sag to its lowered position by gravity. Virtually no ball passing through aperture 42 can ever rebound through said aperture. On the other hand, the momentum of baseballs striking sheet 36 is absorbed both by the yieldability of the sheet itself, and by the resilient yieldability of its mounting studs 28 in sockets 18. Therefore such balls tend to be stopped "dead" when striking the sheet, rather than rebounding therefrom to any great degree, so that they simply drop to the ground closely adjacent the sheet, and do not require "fielding" or chasing. If the ball should actually strike the screw 38 affixed said sheet to any one of studs 28, or closely adjacent thereto, the stud will simply be forced rearwardly into its associated socket 18 against spring 22, until the momentum of the ball is absorbed. This avoids damage either to the mountings of the sheet, or to the ball itself, as a result of the impact.

Sheet 36, and a chute 46 carried thereby, is not supported by any rigid means either at or even closely adjacent aperture 42, and so is free to yield with the impact of a ball thereagainst. If a ball strikes sheet 36 directly at a margin of the aperture, the sheet will either yield laterally to the line of travel of the ball to allow the ball to pass through the aperture, or will not yield laterally and thus allow the ball to drop to the ground, depending usually on whether the greater portion of the width of the ball, transversely of its line of travel, is at the aperture side or the sheet side of the aperture margin. Likewise, if a ball should strike the forward edge of any of the chute partitions 54 or 56, it will deflect the partition laterally, and pass into the chute pocket at the side of the partition toward which the greater portion of the transverse width of the ball is disposed. In either event, damage to the structure of the device is avoided.

While I have shown and described a specific embodiment of my invention, it will be readily apparent that many minor changes of structure and operation could be made without departing from the spirit of the invention.

What I claim as new and desire to protect by Letters Patent is:

1. A baseball pitching practice device comprising:

a. a stand, b. means operable to anchor said stand relative to the ground, in upstanding relation from the ground, c. a generally rectangular sheet of flexible material disposed in a generally vertical plane and having an aperture forming a strike zone formed therein whereby a pitcher may pitch baseballs at the exposed forward surface of said sheet to pass through said aperture, said sheet being spaced forwardly from said stand and said stand being disposed entirely behind said sheet, and d. connecting means extending forwardly from said stand and connected to the peripheral edge of said sheet, said connecting means being resiliently yieldable in a rearwardly horizontal direction, whereby to be yieldable under the impact of baseballs striking said sheet in the area of said connecting means, said connecting means comprising a series of horizontal, forwardly-opening socket members affixed to said stand in spaced relation about the periphery of said sheet, an elongated horizontal stud slidably mounted in each of said sockets and affixed at its forwardly extended end to said sheet, and a spring yieldably resisting rearward movement of said stud in said socket member.

2. A baseball pitching practice device comprising:

a. a stand, b. means operable to anchor said stand relative to the ground, in upstanding relation from the ground, c. a generally rectangular sheet of flexible material disposed in a generally vertical plane and having an aperture defining a strike zone formed therein, whereby a pitcher may pitch baseballs at the exposed forward surface of said sheet to pass through said aperture, d. means connecting the peripheral edge of said sheet to said stand, said sheet being otherwise spaced apart from said stand, e. a generally horizontally extending chute formed of flexible material, being closed at its rearward end and having an open mouth at its forward end, f. an endless loop of elastic cord secured to said chute around the periphery of the mouth thereof, and g. a series of hooks affixed to the rearward surface of said sheet in spaced relation around the periphery of said aperture, and opening outwardly from said aperture, said endless loop of elastic cord, when tensioned, being engageable in said hooks.

3. A baseball pitching practice device comprising:

a. a stand, b. means operable to anchor said stand relative to the ground, in upstanding relation from the ground, c. a generally rectangular sheet of flexible material disposed in a generally vertical plane and having an aperture defining a strike zone formed therein, whereby a pitcher may pitch baseballs at the exposed forward surface of said sheet to pass through said aperture, d. means connecting the peripheral edge of said sheet to said stand, said sheet being otherwise spaced apart from said stand, e. a generally horizontally extending chute closed at its rearward end and having an open mouth at its forward end, and f. means operable to secure the mouth of said chute to the rearward surface of said sheet, with the open mouth thereof in encircling relation to the aperture of said sheet, said chute being provided with longitudinally extending partitions whereby said chute is divided cross-sectionally into a series of pockets, the forward edges of said partitions intersecting the aperture of said sheet and dividing it into a series of zones each corresponding to one of said chute pockets, whereby a baseball passing through any one of said zones will enter the corresponding pocket of said chute.

4. A device as recited in claim 3 wherein both said sheet and its partitions are formed of flexible material.

5. A device as recited in claim 4 wherein said means securing said chute to said sheet comprises:

a. an endless loop of elastic cord secured to said chute around the periphery of the mouth thereof, b. a grid of elastic cords corresponding in pattern to the cross-sectional pattern of the partitions of said chute extending across and secured to said endless cord loop, the forward edges of said partitions being secured to the corresponding elastic cords of said grid, and c. a series of hooks affixed to the rearward surface of said sheet in spaced relation around the periphery of the aperture, and opening outwardly from said aperture, said endless loop of elastic cord, when tensioned, being engageable in said hooks.

* * * * *